United States Patent [19]

Liddell

[11] 3,996,757

[45] Dec. 14, 1976

[54] APPARATUS FOR PROTECTING METALLIC STRUCTURAL ELEMENTS AGAINST CORROSION

[76] Inventor: Orval E. Liddell, P.O. Box 1533, Avalon, Calif. 90704

[22] Filed: July 22, 1974

[21] Appl. No.: 490,316

Related U.S. Application Data

[63] Continuation of Ser. No. 310,831, Nov. 30, 1972, abandoned, Continuation of Ser. No. 103,432, Jan. 4, 1971, abandoned.

[52] U.S. Cl. ..... 61/54

[51] Int. Cl.[2] ..... E02D 5/60

[58] Field of Search ..... 61/54; 52/724, 726, 52/728

[56] References Cited

UNITED STATES PATENTS

| | | | |
|---|---|---|---|
| 2,928,411 | 3/1960 | Johnson | 61/54 X |
| 3,027,610 | 4/1962 | Liddell | 61/54 |
| 3,139,731 | 7/1964 | Liddell | 61/54 |
| 3,553,970 | 1/1971 | Wiswell | 61/54 |
| 3,719,049 | 3/1973 | Shaw et al. | 61/54 |

*Primary Examiner*—Jacob Shapiro

*Attorney, Agent, or Firm*—Fulwider, Patton, Rieber, Lee & Utecht

[57] ABSTRACT

Apparatus for protecting a partially or fully submerged metallic structural element against corrosion from water, air or a combination of both. A pliable watertight and airtight encasement is wrapped around the portion of the element to be protected. Seal means are utilized to seal the edges of the encasement against water and air. If the encasement is of an irregular shape, fillers are secured to the structural element, such fillers having a circular configuration, and the encasement is wrapped around the fillers.

4 Claims, 23 Drawing Figures

APPARATUS FOR PROTECTING METALLIC STRUCTURAL ELEMENTS AGAINST CORROSION

This application is a continuation of my applications Ser. Nos. 103,432 and 310,831 filed Jan. 4, 1971, and Nov. 30, 1972, both now abandoned respectively.

BACKGROUND OF THE INVENTION

1. Field of the Invention

The present invention relates to apparatus for protecting a partially or fully submerged metallic structural element against corrosion from air, water or a combination of both.

2. Description of the Prior Art

It is common to protect the submerged portion of a metallic structural element from corrosion by cathodic methods. Such cathodic protection is expensive and only protects the submerged portion of the metallic element and not the portion thereof in the splash zone. Corrosion protection has also been provided for both the submerged and air-exposed portions of such metallic elements by means of noncorrosive coatings. When such coatings fail, however, they cannot readily be replaced on the submerged portion of the metallic element, and it is expensive to replace such coatings on the splash zone portion of such element. It has also been proposed to add concrete sleeves around such metallic elements. This process is quite expensive, and additionally, such concrete sleeves are difficult to install. For section of metallic elements above water and exposed to air and mixture, the usual practice has been to apply noncorrosive coatings, such as paints, metallic coatings, epoxies and the like to protect against corrosion. These methods have been expensive and the service life is limited.

SUMMARY OF THE INVENTION

The present invention is characterized by a pliable watertight and airtight encasement which is wrapped about the length of a metallic structural element to be protected from water and air corrosion in a sealing relationship with respect to both water and air. This arrangement prevents corrosion of the covered portion of the metallic element. Filler blocks are provided where the metallic element is not of cylindrical transverse cross-section. Such filler blocks have a circular outer edge so as to permit the encasement to be snugly wrapped around and then secured to such blocks.

For the installation of this pliable waterproof and airtight sealed encasement, any existing surface corrosion deposits will not be removed as this corrosion coating provides an initial surface protection of the base metal surface. This corrosion deposit will only be made sufficiently smooth to provide a reasonably snug contact of the encasement with the metallic element surface.

The advantages of this invention are the use of proven, long life materials of proven corrosion resistance, no surface cleaning required, the installation can be made in-place on any metallic element, whether above water, at the splash zone or completely below water without any interferences with operations of the structure, in installation is very simple and easy to apply, the cost is far below other present corrosion protective methods and the service life will greatly exceed that now being realized with other methods. It is estimated that this design of pliable sheet encasement will provide a service life of over 30 years.

DESCRIPTION OF PREFERRED EMBODIMENTS

Figure 1:
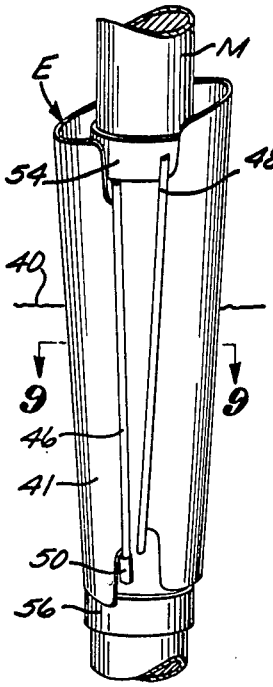
FIG. 1 is a side view showing apparatus embodying the present invention being applied to a metallic structural element.

Referring to the drawings and particularly FIG. 1 thereof, there is shown a metallic structural element M which is shown partially submerged in seawater to a level indicated at 40. A pliable water and airtight encasement E is shown being applied to a submerged portion of element M and the splash zone portion of such element above the submerged portion. The encasement E includes a substantially rectangular sheet of synthetic plastic material 41. A suitable synthetic plastic is polyvinyl chloride. Other similar materials, however, will prove satisfactory. The sheet 41 has a width throughout its length exceeding the corresponding circumference of the element M. The vertical edges of the encasement sheet E are stiffened or rigidly reenforced against bending by a pair of vertically extending pole pieces 46 and 48.

Figure 2:
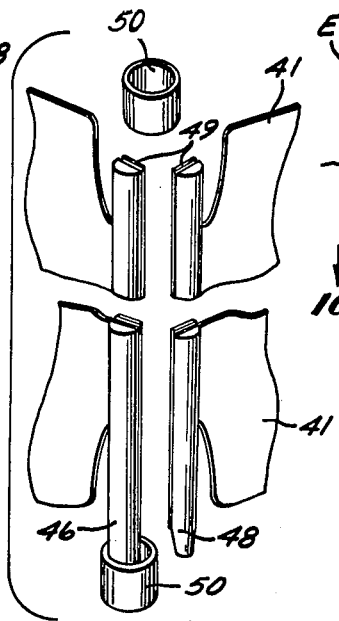
FIG. 2 is a broken perspective view of such apparatus.

Referring now additionally to FIG. 2, both of the pole pieces 46 and 48 are semicylindrical and are formed of wood, metal, synthetic plastic or the like. The flat side of each pole piece is rigidly affixed as by the stapling or cement to its respective edge of the encasement sheet 41. The pole pieces 46 and 48 permit the sheet to be readily manipulated for placement around the structural element M. Along the flat sides of pole pieces 46 and 48 are attached strips 49 of polyurethane foam, polyether foam, neoprene foam, mastic or any other suitable material that, when compressed, will form a waterproof and air proof longitudinal seal. With the encasement sheet E partially wrapped around the columnar element M in the manner shown in FIG. 1., the lower ends of the pole pieces 46 and 48 are releasably joined by means of a lower socket 50 secured to the lower end of one of the pole pieces 46. Thereafter, the lower end of the other pole piece 48 is inserted in the socket 50 in a nonrotational manner. Next, the two pole pieces are brought together to define a substantially cylindrical unit.

Figure 3:
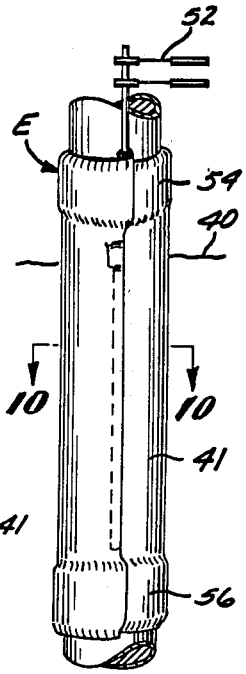
FIG. 3 is a side view of said apparatus being secured to the structural element.
Figure 4:
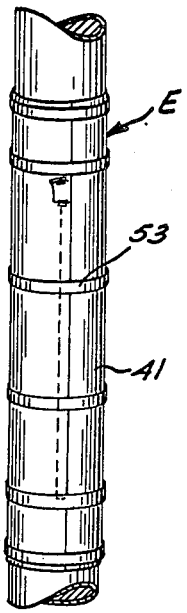
FIG. 4 is a side view showing the appearance of said apparatus after it has been applied to a structural element.

Referring now to FIG. 3, the joined-together pole pieces may then be tightened by means of wrenches 52, such wrenches rotating the pole pieces about their vertical axes. During this tightening operation, the strips 49 will be compressed to form a longitudinal waterproof and air proof seal against the entry of corrosive media. Referring now to FIG. 4, thereafter a plurality of wrapping bands 53 are applied to vertically-shaped points along the encasement E to retain it upon the element M.

Upper and lower sealing bands are provided for the upper and lower edges of the encasement sheet E, such bands being designated 54 and 56 in FIGS. 1 and 3, and showing as bulges 54 and 56 in FIG. 3. These sealing bands 54 and 56 are wrapped about the structural element M at points corresponding to the upper and lower edge portion of the encasement sheet 41 when the latter has been installed upon element M. Such seal bands 54 and 56 are preferably formed of a material having physical characteristics such that it will have a memory and may be compressed to a fraction of its unconfined volume and thereafter it will exert a pressure in its attempt to regain its original uncompressed shape. Suitable materials are polyurethane foam, polyether foam, neoprene foam or other readily compressible materials with high resilience and with a memory such that they will continually exert a sealing pressure while compressed. It should be understood that the material of the upper and lower sealing bands are compressed by the encasement sheet 41 when the latter is installed.

Figure 5:
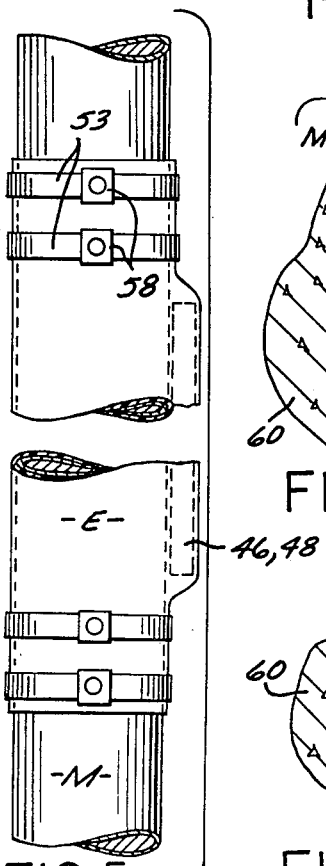
FIG. 5 is a broken side elevational view taken in enlarged scale and particularly showing the end seals of such apparatus.

Referring again to FIG. 4 and additionally to FIG. 5, the wrapping bands 53 are of like construction. Conveniently, these bands will take the form of a noncorrosive plastic, synthetic or metallic strap which is tightened about the element M by means of a suitable hand tool, and the ends of such band thereafter rigidly secured together by means of a clamp or clip 58. It will be apparent that other sealing arrangements may be utilized.

With the wrapping bands 53 in position, the encasement E will be firmly retained upon the element M. The upper and lower wrapping will serve to compress the upper and lower edge of encasement sheet 41 and the foam seal bands against the element E and in this manner effect a water and airtight seal at the upper and lower edges of the encasement E. Accordingly, the portion of the element M covered by the encasement E will be effectively sealed against contact with both seawater and air. Corrosion from these elements will thereby be effectively prevented.

Figure 6:
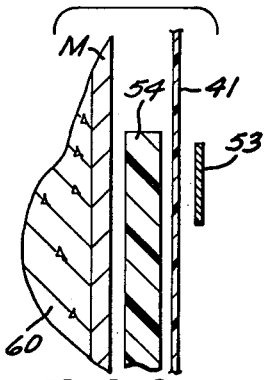
FIG. 6 is a horizontally exploded fragmentary view taken in further enlarged scale showing an end sealing arrangement which may be utilized with said apparatus.
Figure 7:
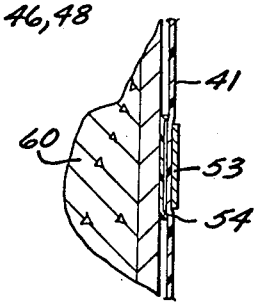
FIG. 7 and 8 are views similar to FIG. 6 showing how the sealing rings are applied.
Figure 8:
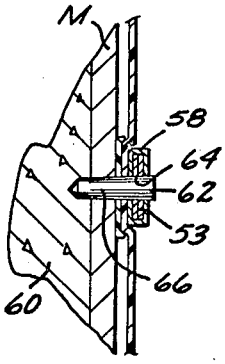
Figure 9:
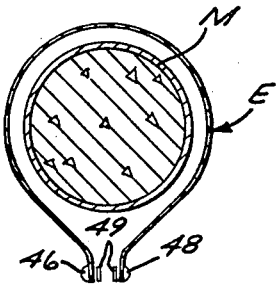
FIG. 9 is a horizontal sectional view taken on line 9—9 of FIG. 1.
Figure 10:
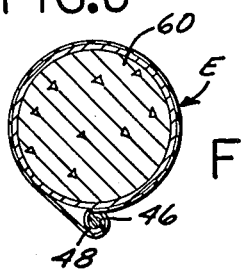
FIG. 10 is a horizontal sectional view taken in enlarged scale along line 10—10 of FIG. 3.

Referring now to FIGS. 6, 7 and 8, the arrangement for sealing the end portions of the encasement E to the exterior surface of the element M is disclosed in detail. It will be noted from these drawings that the interior of the element M may be filled with concrete 60.

Referring particularly to FIG. 8, after the wrapping bands 53 have been tightened and wedged together by means of the clip 58, a tapered pin 62 may be driven through a bore 64 formed centrally through the clip 58 and an aligned bore 66 formed in the element M to be thereafter embedded in the concrete 60. This will provide effective securement for the wrapping band 53 to the element. The pin 62 may be formed of fiberglass or some other suitable noncorrosive material. Alternate commercial banding methods can also be used.

Figure 11:
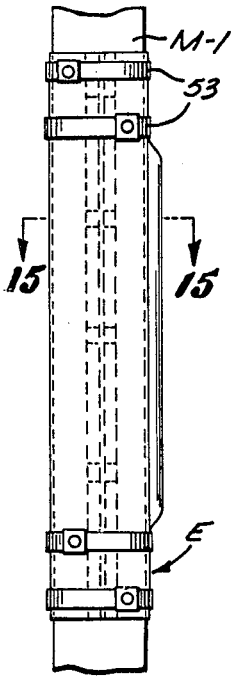
FIG. 11 is a side elevational view showing how the apparatus of the present invention is applied to an H-shaped metallic structural element.
Figure 15:
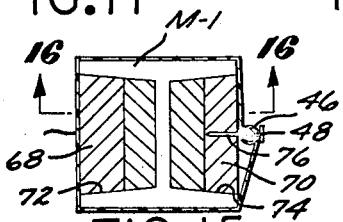
FIG. 15 is a horizontal sectional view taken in enlarged scale along line 15—15 of FIG. 11.

Referring now to FIGS. 11 and 15, there is shown a metallic structural element M-1 having a noncontinuous transverse cross-sectional configuration, i.e., said element is of generally H-shaped configuration. In order to provide a smooth, continuous exterior cross-sectional profile to receive the encasement E, a pair of filler blocks 68 and 70 are inserted between the opposed cavities 72 and 74 defined by the legs of the element M-1. The filler blocks 68 and 70 extend approximately the length of encasement E and may be formed of wood or any other suitable corrosion resistant material. If wood is used, it should be chemically treated to resist marine borers, dry rot and fungus decay in a conventional manner. Additionally, it should be noted that if wood is used, such wood may be covered with a suitable synthetic plastic such as polyvinyl chloride. The filler blocks could also be formed of molded, noncorrosive synthetic plastic.

The encasement E is generally similar to that shown and described hereinbefore, including pole pieces 46 and 48. As indicated in FIG. 15, however, the pole pieces are maintained against rotation by means of a noncorrosive nail or pin 76 which is driven through the pole and into one of the filler blocks 70. Wrapping bands 53 similar to those shown and described hereinbefore are employed to retain the encasement E in place on element M-1, with the upper and lower edges thereof sealed relative to such element by sealing bands such as those designated 54 nd 56 hereinbefore. Alternatively, a sealant such as a conventional mastic may be employed.

Figure 12:
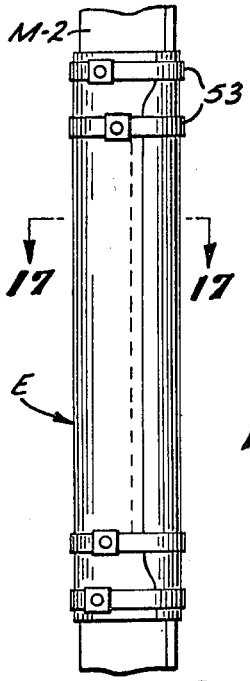
FIG. 12 is a view similar to FIG. 1, but showing a V-shaped element.
Figure 17:
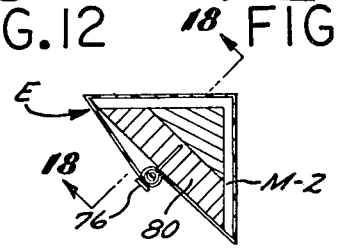
FIG. 17 is a horizontal sectional view taken in enlarged scale along line 17—17 of FIG. 12.
Figure 18:
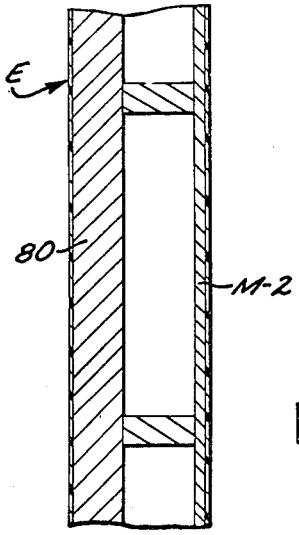
FIG. 18 is a vertical sectional view taken along line 18—18 of FIG. 17.

Referring now to FIGS. 12, 17 and 18, there is shown a metallic structural element M-2 of generally V-shaped transverse cross-section. A longitudinally extending filler block 80 is provided for the space between the legs of the element M-2. This filler block 80 extends for approximately the length of the encasement E, such encasement E being similar to that shown and described hereinbefore. As with the form of the invention shown in FIGS. 11 and 15, the pole pieces are affixed to the filler block 80 by means of a nail or pin 76.

Figure 13:
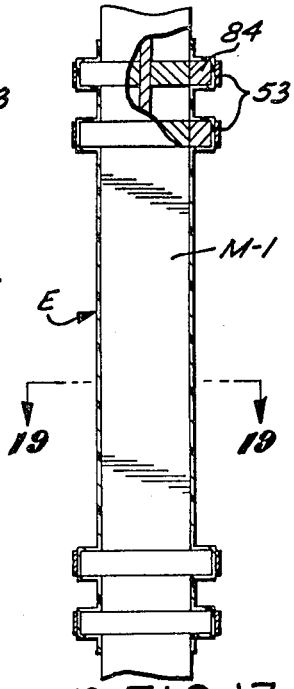
FIG. 13 is a view similar to FIG. 11, but showing the use of spacers with an H-shaped element where circular wrapping is not used.
Figure 14:
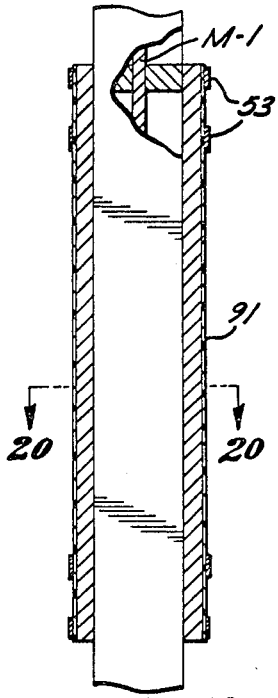
FIG. 14 is a view similar to FIG. 13 but showing another form of spacer arrangement.
Figure 19:
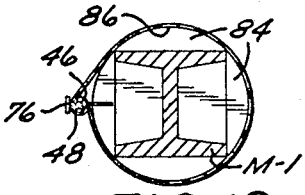
FIG. 19 is a horizontal sectional view taken in enlarged scale along line 19—19 of FIG. 13.
Figure 16:
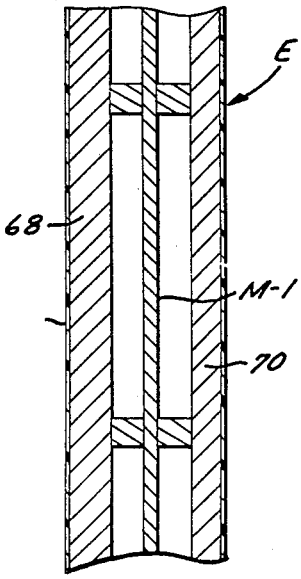
FIG. 16 is a vertical sectional view taken in cross-section along line 16—16 of FIG. 15.

Referring now to FIGS. 13 and 19, there is shown a generally H-shaped metallic structural element M-1 similar to that shown in FIGS. 15 and 14. In this form of the invention, however, the filler blocks do not extend longitudinally a length approximating the length of the encasement E. Instead, filler blocks 84 are provided only at the upper and lower portion of the encasement E. These filler blocks 84 are of arcuate configuration and serve to define a cylindrical transverse cross-section for receiving seals and wrapping bands 53 at the upper and lower portions of the encasement E. A suitable sealant (not shown) is interposed between the outer curved edges 86 of the filler blocks 84. A suitable nail or pin 76 is driven through the pole pieces 46 and 48 into one of the filler blocks 84, as indicated in FIG. 19.

Figure 20:
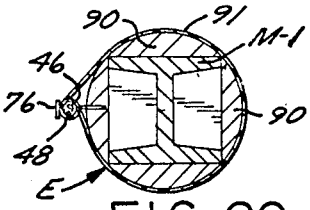
FIG. 20 is a horizontal sectional view taken in enlarged scale along line 20—20 of FIG. 14.

Referring now to FIGS. 14 and 20, a generally H-shaped structural element M-1 is again shown. In this form of the invention, however, filler blocks 90 having a profile similar to the filler blocks 84 are provided. However, the filler blocks 90 extend longitudinally the approximate length of the encasement E to form a cylindrical edge surface 91. A nail or pin 76 is again driven through the pole pieces 46 and 48 to secure such pole pieces to the element M-1. Suitable sealing means (not shown) are provided underneath the wrapping bands 53.

Figure 21:
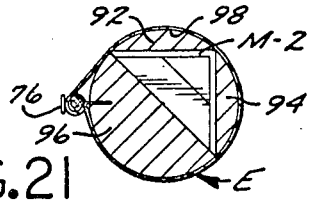
FIG. 21 is a horizontal sectional view similar to FIG. 17, but showing a different configuration of the spacers.

Referring now to FIG. 21, there is shown a metallic structural element M-2 of generally V-shaped transverse cross-section similar to that shown in FIGS. 12, 17 and 18. In FIG. 12, however, the element M-2 is shown provided with a pair of filler blocks 92 and 94 secured to the exterior surfaces of the legs of such element and a third filler block 96 of semicylindrical profile. The filler blocks 92, 94 and 96 cooperate to define a cylindrical edge surface 98 for receiving the encasement E. A nail or pin 76 is extended through the pole pieces 46 and 48 into the filler block 96.

Figure 22:
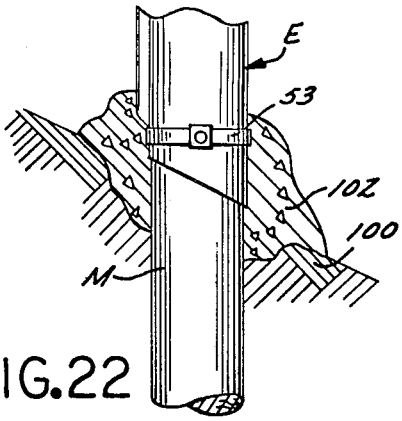
FIG. 22 is a side elevational view showing how concrete, mastic, epoxies, or other sealing materials can be utilized to seal the lower end of an encasement of the present invention.

Referring now to FIG. 22, there is shown a cylindrical metallic columnar element M which is driven into the earth 100 and extends upwardly through a body of water. The lower portion of an encasement E of the type described hereinabove the foam 54 and seal band 53, is covered with a hand-packed quantity of concrete or mortar 102 to assist in the sealing of the lower portion of the encasement E.

Figure 23:
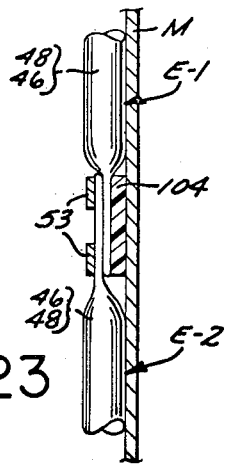
FIG. 23 is a side view showing a seal between two modular units of the present invention.

Referring now to FIG. 23, there is shown a sidewall of a metallic structural element M, provided with a pair of like upper and lower encasements E-1 and E-2, respectively. These upper and lower encasements define modular encasement units. The pole pieces 46 and 48 of the upper and lower encasement units E-1 and E-2 are sealed by means of a single foam seal band 104 and a pair of wrapping bands 53.

Various modifications and changes may be made with respect to the foregoing detailed description without departing from the spirit of the present invention.

I claim:

1. Apparatus for protectively encasing an installed metallic columnar structural element against corrosion from water, air or a combination of water and air, comprising:

a generally rectangular, synthetic plastic, pliable water and airtight encasement sheet of a length at least as great as the length of the portion of said structural element to be protected, said encasement sheet being wrapped about the portion of said structural element to be protected with its edges overlapping;

a pair of vertically extending, abutting pole pieces secured to the edges of said encasement sheet in a rolledtogether water and airtight relationship with respect to the edges of said encasement sheet whereby said sheet is held against said portion of said structural element;

upper and lower sealing bands of compressible foam interposed between the upper and lower portions of said encasement sheet and said structural element with the upper and lower ends of said pole pieces terminating below and above said upper and lower sealing bands, respectively; and upper and lower wrapping bands extending around the upper and lower portions of said encasement sheet and said pole pieces to compress said sealing bands into a water and air sealing relationship with the upper and lower ends of said encasement sheet, said wrapping bands also retaining said encasement sheet and said pole pieces firmly upon said structural element, with said sealing bands and rolled-together pole pieces cooperating with said encasement sheet to prevent the entry of air and water into the space between said sheet and the portion of said structural element to be protected.

2. Apparatus as set forth in claim 1 wherein said structural element is of a noncontinuous cross-sectional configuration and said apparatus further comprises back-up means attached to said structural element and extending along the portion thereof to be protected to thereby provide said portion of said structural element with a smooth continuous exterior cross-sectional profile.

3. Apparatus as set forth in claim 1 wherein a strip of compressible foam sealing material extends along said pole pieces.

4. Apparatus as set forth in claim 2 wherein a strip of compressible foam sealing material extends along said pole pieces.

* * * * *